US006502763B1

(12) United States Patent
McCann

(10) Patent No.: US 6,502,763 B1
(45) Date of Patent: Jan. 7, 2003

(54) REMOVABLE MULTIPLE ORIFICE SPRAY TIP

(75) Inventor: Thomas F. McCann, Avondale, PA (US)

(73) Assignee: American Spray Parts, Avondale, PA (US)

( * ) Notice: Subject to any disclaimer, the term of this patent is extended or adjusted under 35 U.S.C. 154(b) by 0 days.

(21) Appl. No.: 09/761,266

(22) Filed: Jan. 17, 2001

(51) Int. Cl.[7] ..... B05B 15/02; B05B 1/28; B05B 15/04; B05B 1/00

(52) U.S. Cl. ..... 239/119; 239/288.3; 239/600

(58) Field of Search ..... 239/119, 288, 239/288.3, 288.5, 600, DIG. 14, 390, 391, 392, 393, 436, 444, 395, 394

(56) References Cited

U.S. PATENT DOCUMENTS

| | | | | |
|---|---|---|---|---|
| 3,414,196 A | | 12/1968 | Legeza et al. | |
| 4,116,386 A | | 9/1978 | Calder | |
| 4,484,707 A | | 11/1984 | Calder | |
| 4,830,281 A | | 5/1989 | Calder | |
| 5,255,848 A | | 10/1993 | Rhodehouse | |
| 5,280,853 A | | 1/1994 | Perret, Jr. | |
| 5,294,053 A | | 3/1994 | Perret, Jr. | |
| 5,379,939 A | | 1/1995 | Perret, Jr. | |
| 5,454,515 A | * | 10/1995 | Perret | 239/119 |
| 5,893,522 A | * | 4/1999 | Kieffer | 239/600 |
| 5,947,381 A | * | 9/1999 | Carey | 239/119 |

* cited by examiner

*Primary Examiner*—Henry C. Yuen
*Assistant Examiner*—Davis Hwu
(74) *Attorney, Agent, or Firm*—Huntley & Associates

(57) ABSTRACT

The present invention provides a removable reversible spray tip member for use with a variety of airless spray systems, wherein the spray tip comprises multiple orifice members.

13 Claims, 2 Drawing Sheets

REMOVABLE MULTIPLE ORIFICE SPRAY TIP

BACKGROUND OF INVENTION

The present invention relates to a multiple orifice spray tip for airless spraying that can be used with high pressure liquid spray systems such as paint sprayers.

High pressure airless paint spraying equipment generally consists of a pump to develop fluid pressure, a hose, a gun or shut off device and a spray orifice, or tip, held to the front of the gun with a retainer. Fluid is delivered to the gun via the hose and exits the system through the spray tip. A spray tip for airless paint spraying consists of a small orifice through which the paint is forced at high pressure. The shape and size of the orifice opening determines the shape of the spray pattern and the amount of paint being applied.

The small size of the spray tip orifice opening often results in plugging of the opening. A common remedy for this condition is to reverse the direction of the material flow through the orifice. This can be achieved by rotating the spray tip 180 degrees within the tip retainer, forcing material through the orifice in the opposite direction to dislodge the plug. Once the foreign matter is purged from the orifice, the spray tip is rotated back 180 degrees to resume spraying. This method of "reversible" cleaning or "reversible spray tips" is disclosed in U.S. Pat. No. 949,489.

Commonly sprayers are operated from ladders, scaffolding, man-lifts. The structure being painted may be a tower, water tank, bridge, ship, ceiling or other difficult to access surface. The ability to change spray tips in the simplest manner possible is desirable. This includes minimal disassembly of parts that can drop and be lost, rendering the sprayer inoperable. The need for tools for spray tip interchange increases the number of items that must be on hand in remote locations as well as increases the complexity of the task of changing spray tips. Furthermore, removing the spray tip is required when cleaning the system, replacing worn tips and selecting a tip with different spraying characteristics. Spray tip interchangeability is complicated by the need to produce a seal between the nozzle and the spray gun that will not leak under high pressure.

The abrasive nature of paint as well as the high pressures required to operate an airless spraying system leads to rapid wear of the spray tip orifice. Significant wear can be seen in as little as 8 gallons of paint. Wom spray tip orifices increase the volume of paint allowed to flow through them. Additionally, worn spray tip orifices reduce the size of the spray pattern produced. The combination of a reduced spray pattern and a higher flow of material cause a number of problems for the operator including; poor finish quality, inconsistent coverage, runs and sags. Material and time is wasted as more paint is applied to a smaller surface area. For this reason it is practical to replace worn tips frequently. Furthermore paint sprayers have a maximum orifice size they can support based on the output of the paint pump. If a spray orifice wears to a size larger than that which the paint pump can support, spraying pressure decreases and the coating no longer atomizes resulting in poor surface finish quality.

There is a continuing need for reversible spray tip members having multiple orifices housed within a single spray tip body.

SUMMARY OF THE INVENTION

This invention provides a faster and simpler way of exchanging a worn spray orifice for a new one. This invention requires no modifications or additional parts to be used on the majority of airless spray systems currently available. For these reasons this invention provides multiple spray orifices of the same size and oriented in the same orientation within one spray tip. The additional orifices are provided as replacements to compensate for the effects of a worn orifice and not as orifices which produce different spray characteristics. Given the ability of the operator to vary spray pattern size and coverage thickness by varying speed and distance to surface, the ability to access a fresh, unworn orifice is more valuable than accessing an orifice of a different size.

It is the purpose of this invention to provide a spray tip that is quickly interchangeable, has multiple orifices and is rotatably cleanable. Furthermore, the invention combines these three features while operating within a standard unmodified tip retainer. Such a retainer is the most common type available and already in place on the majority of spray guns. The size of the spray orifices is critical for allowing correct placement of the spray orifices within the cylindrical turret. The spray orifices must be sized so as to allow for multiple orifices to fit on a cylinder of the size necessary to fit within commonly available tip retainers. Furthermore the spray orifices must be spaced along the cylindrical turret so as to cover the inactive spray orifice to protect it from contamination by overspray or paint build up.

Specifically, the present invention provides, in a spray gun of an airless spray system comprising a housing, a spray guard, a transverse passage and an orthogonal bore connected to the transverse passage, a removable, rotatable cylindrical turret member having a handle and at least one orifice member mounted in at least one transverse bore, the turret member being adapted for insertion into the orthogonal bore of the spray gun housing in a position wherein at least one of the orifice members of the turret member is aligned with the transverse passage, the turret member further comprising at least one removable spacer.

The present invention also provides, in a spray gun comprising a housing, a spray guard, a transverse passage and an orthogonal bore connected to the transverse passage, a removable, rotatable cylindrical turret member having a handle and at least one orifice member mounted in at least one transverse bore, the turret member being adapted for insertion into the orthogonal bore of the spray gun housing in a position wherein at least one of the orifice members formed in the at least one transverse bore of the turret member is aligned with the transverse passage of the housing, the turret member further comprising at least one removable tab positioned to interact with the housing to limit the rotational movement of the turret when inserted into the orthogonal bore of the spray gun housing.

The present invention also provides a turret member assembly for use with a spray gun of an airless spraying system, the spray gun comprising a spray gun housing, the spray gun housing having a longitudinal passage connected to an adjacent orthogonal bore, the orthogonal bore being adapted for the insertion of the turret member, the turret member being cylindrical and having at least two transverse passages formed therein, each passage having an orifice spray tip member disposed therein, the turret member further comprising a handle and at least one removable spacer.

The present invention also provides a turret member assembly for use with a spray gun of an airless spraying system, the spray gun comprising a spray gun housing, the spray gun housing having a longitudinal passage connected to an adjacent orthogonal bore, the orthogonal bore being adapted for the insertion of the turret member, the turret member being cylindrical and having at least two transverse passages formed therein, each passage having an orifice spray tip member disposed therein, the turret member further comprising a handle and at least one removable spacer; the housing further comprising at least two parallel channels formed therein, each channel being adapted to interact with one of the at least one removable spacers to define and restrict the position and rotational movement of the turret when inserted into the orthogonal bore.

The present invention also provides a turret member assembly for use with a spray gun of an airless spraying system, the spray gun comprising a spray gun housing, the spray gun housing having a longitudinal passage connected to an adjacent orthogonal bore, the orthogonal bore being adapted for the insertion of the turret member, the turret member being cylindrical and having at least two transverse passages formed therein, each passage having an orifice spray tip member disposed therein, the turret member further comprising a handle and a tab; the housing further comprising at least two parallel channels formed therein, each channel being adapted to interact with the tab to define and restrict the position and rotational movement of the turret when inserted into the orthogonal bore.

DETAILED DESCRIPTION OF THE INVENTION

Figure 2:
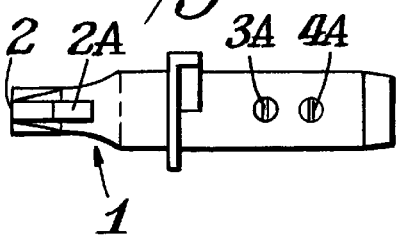
FIG. 2 is a left side elevational view of the spray tip member of FIG. 1.
Figure 1:
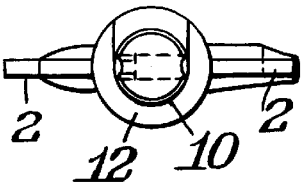
FIG. 1 is a front elevational view of a spray tip member of the present invention.
Figure 3:
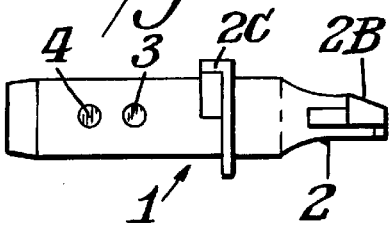
FIG. 3 is a right side elevational view of the spray tip member of FIG. 1.

The present invention will be more fully understood by reference to the drawings, which show specific preferred embodiments of a device of the present invention alone and in combination with typical airless spray devices with which the present invention is adapted for use. Variations and modifications of the embodiments shown can be substituted without departing from the principles of the invention, as will be evident to those skilled in the art.

The various embodiments of the present invention are adapted for use with airless spray systems. More specifically, the present invention is adapted for use with airless high pressure paint spray systems. Such systems typically comprise a pump to develop pressure, a hose connecting the pump to a spray gun, the spray gun comprising a housing in which the present invention is incorporated. The spray gun is adapted to stop the flow of pressurized fluid or paint, and to control its emission from the gun.

Fluid is delivered to the gun via the hose and exits the gun through the spray tip. A spray tip for airless paint spraying consists of at least one small orifice through which the paint is forced at high pressure. The shape and size of the orifice opening determines the shape of the spray pattern and the amount of paint being applied.

The small size of the spray tip orifice opening often results in plugging of the opening. A common remedy for this condition is to reverse the direction of the material flow through the orifice. This can be achieved by rotating the spray tip 180 degrees within the spray gun housing, forcing fluid through the orifice in the opposite direction to dislodge the plug. Once the foreign matter is purged from the orifice, the spray tip can be rotated back 180 degrees to resume spraying.

The present invention provides a reversible, rapidly replaceable multiple orifice spray tip for use with the spray gun of an airless spray system, and can be used with a wide variety of current spray gun housings without modification to the housing. The removable, reversible spray tip consists of a cylindrical turret having multiple spray orifices. Attached to the turret is a handle for insertion and removal of the spray tip into and out of the spray gun housing. The handle can also be used for rotation of the turret to and from the reversed position for cleaning.

As shown in FIGS. 1–3, 6 and 7–9, a preferred embodiment of the reversible, multiple orifice spray tip member 1 of the present invention is shown. The spray tip member can also be called a turret member herein, and each term is used interchangeably herein. The preferred spray tip member 1 shown in FIGS 1–3, 6 and 7–9 is a cylindrical body comprising a handle 2 attached to a terminal end thereof. The handle can comprise a spray indicator 2A that indicates that the spray tip is in position for use, and a reverse position indicator 2B, that indicates that the spray tip is in the reversed position for cleaning. In addition, the handle may include a tab 2C. The tub 2C can, in alternate embodiments, be a part of the cylindrical body. Two orifice members, 3A and 4A, are mounted in transverse bores 3 and 4 formed in the cylindrical body.

The orifice members are conventional in nature and can be made according to various known methods and with various known materials. The orifice members are typically press fit into their respective transverse bores, and can be assembled according to various methods. The orifice members can be a configured to provide a wide variety of paint streams. Some orifices are designed to provide a tight and narrow stream of paint, while others can be designed to provide a wide stream of paint. All types of orifice members can be used in the present invention, depending on whether the spray tip member is designed for use in spraying walls (wide stream) or trim (narrow stream). The type of orifice members used in a spray tip member can be shown on the handle of the spray tip member. Each spray tip member can comprise multiple orifice members of the same configuration and design, or of differing configuration and design. For example, a spray tip member could have multiple wide orifice members or one wide and one narrow orifice member. In addition, a spray tip member could have more than two orifice members.

All embodiments of the present invention are adapted for use with a spray gun attached by a hose to a pump. As shown in FIGS. 7–11, a typical a spray gun 20 comprises a housing 21 and a means 22 to connect the housing to a hose or to a cut off device such as a trigger valve (not shown). The housing 21 can comprise spray guards 21A and 21B formed at the emission or spray end of the spray gun. A longitudinal passage 23 runs through the housing from the emission end to the opposite end, where it can be connected to a hose or other source for fluid such as paint. An orthogonal bore 24 extends through the housing perpendicular to the longitudinal passage, and intersects the longitudinal passage. The orthogonal bore has an opening formed in the housing at one end thereof. Alternate embodiments of spray guns include those wherein the orthogonal bore has openings formed in the housing at each end thereof Adjacent to the opening in the housing connected to the orthogonal bore is a channel 25. In alternate embodiments of a spray gun that can be used according to the present invention, multiple parallel channels arc formed as shown in FIGS. 16–19. The opening in the housing connected to the orthogonal bore is adapted for insertion of a spray tip member or turret member, 1 of the present invention. The orthogonal bore is also adapted for insertion of the spray tip member.

The spray tip member can be inserted into an orthogonal bore formed in the housing of the spray gun. When inserted, the cylindrical body of the spray tip member forms a seal with the housing, and one of the orifice members of the spray tip member is positioned in alignment with a longitudinal passage formed in the spray gun. The longitudinal passage and the orthogonal bore of the spray gun housing intersect, so that fluid forced from the pump through the hose and into the gun is forced through the longitudinal passage of the spray gun housing, where it meets the spray tip that has been inserted into the orthogonal bore and is positioned to block the longitudinal passage. The orifice members should be spaced a sufficient distance apart, so that when one orifice is aligned with the longitudinal passage of the spray gun housing, the other orifice is covered by the housing. See FIGS. 4 and 8–10. In alternate embodiments, the spray tip member can be provided with a removable sheath to protect the unused orifice members from being clogged or fouled while the other orifice member is in use.

Figure 8:
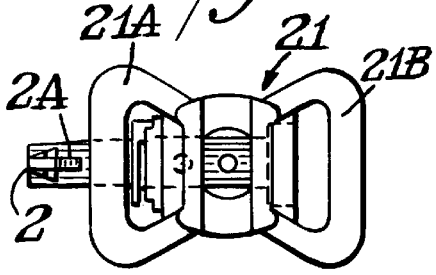
FIG. 8 is a front elevational view of the spray gun housing of FIG. 7 showing the spray tip member in a closed position.
Figure 9:
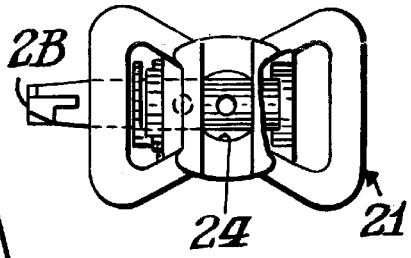
FIG. 9 is a front elevational view of the spray gun housing of FIG. 7 showing the spray tip member in an open position.
Figure 10:
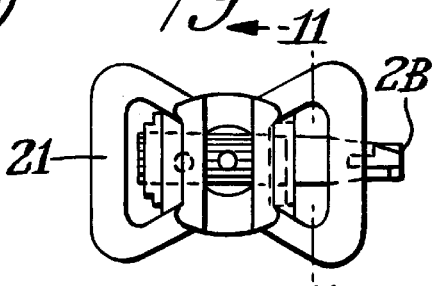
FIG. 10 is a front elevational view of the spray gun housing of FIG. 7 showing the spray tip member repositioned within the housing.
Figure 15:
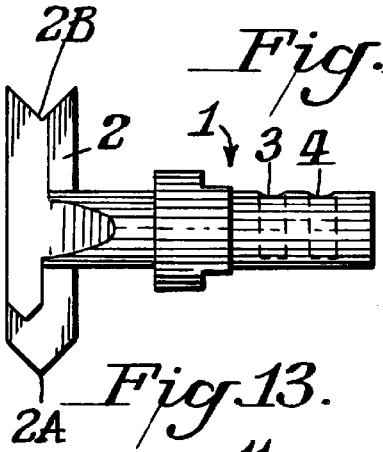
FIG. 15 is a top plan view of the spray tip member of FIGS. 12–14.
Figure 11:
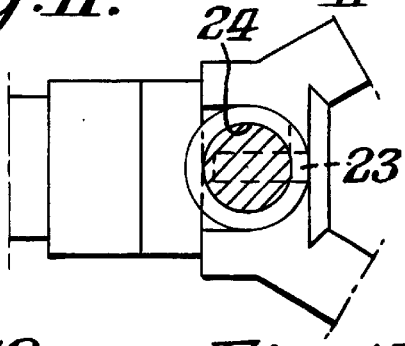
FIG. 11 is a partial cress sectional view in elevation of the spray gun housing taken along lines 11—11 of FIG. 10.
Figure 13:
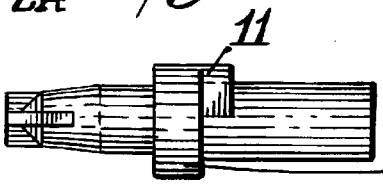
FIG. 13 is a sell side elevational view of the spray tip member of FIG. 12.
Figure 12:
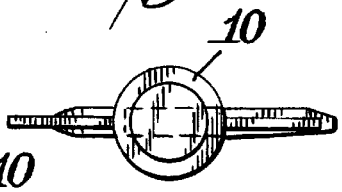
FIG. 12 is a front elevational view of the spray tip member shown in FIG. 7.
Figure 14:
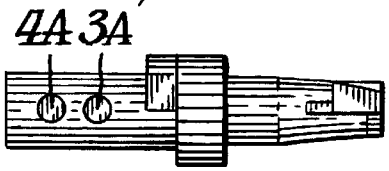
FIG. 14 is a right side elevational view of the spray tip member of FIG. 12

The spray tip member can be positioned so that only one orifice member is positioned in alignment with the longitudinal passage, so that the spray gun can be use to enlit paint or other fluid. The spray tip should be inserted into the orthogonal bore of the housing of the gun, and rotated to a position, as indicated by the handle, for painting or spraying. See FIGS. 4, 9 and 10. In this position, one of the orifice members formed in the transverse bore of the spray tip member is aligned with the longitudinal passage formed in the spray gun housing. In FIG. 8, the spray tip member has been rotated to the reversed position, so the orifice member can be cleaned by reversing the flow of paint through the spray tip.

Figure 4:
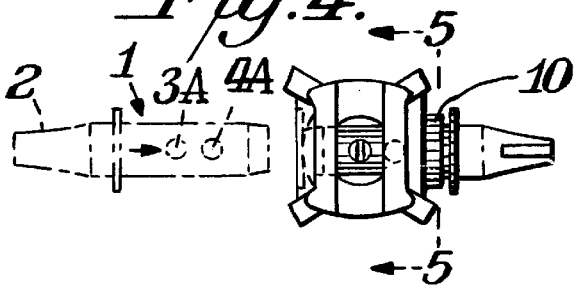
FIG. 4 is a front elevational view of a spray tip member showing a spray tip housing of a spray gun, the spray tip member being in the closed position within the housing, wherein the spray tip is shown in phantom outline repositioned 180° for insertion into a second bore in the housing of the spray gun.
Figure 5:
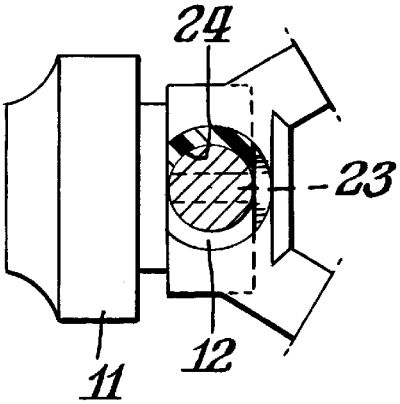
FIG. 5 is a cross sectional view of the housing shown in FIG. 4, taken along line 5—5 of FIG. 4.
Figure 6:
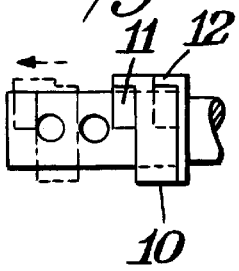
FIG. 6 is a right side elevational view of another spray tip showing a removable spacer and the spacer being removed in phantom outline.
Figure 16:
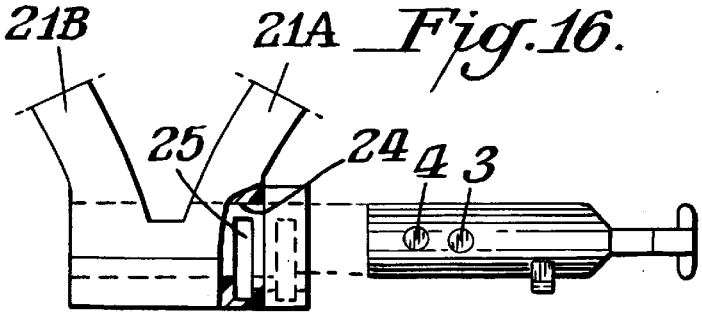
FIG. 16 is a right side elevational view of another embodiment of the spray tip member of the present invention shown removed from a spray gun housing.
Figure 17:
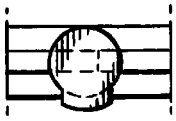
FIG. 17 is a partial front elevational view of the spray tip member of FIG. 16.
Figure 18:
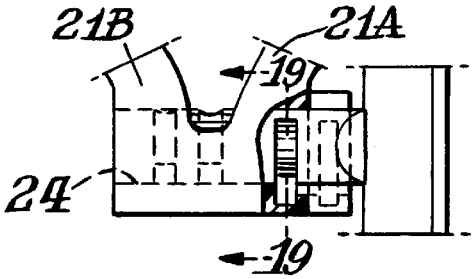
FIG. 18 is a fragmented side elevational view of the spray tip member of FIGS. 16 and 17.
Figure 19:
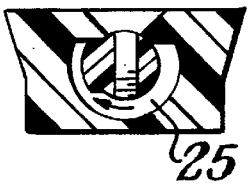
FIG. 19 is a fragmented cross sectional view of the spray tip member taken along line 19—19 of FIG. 18.
Figure 7:
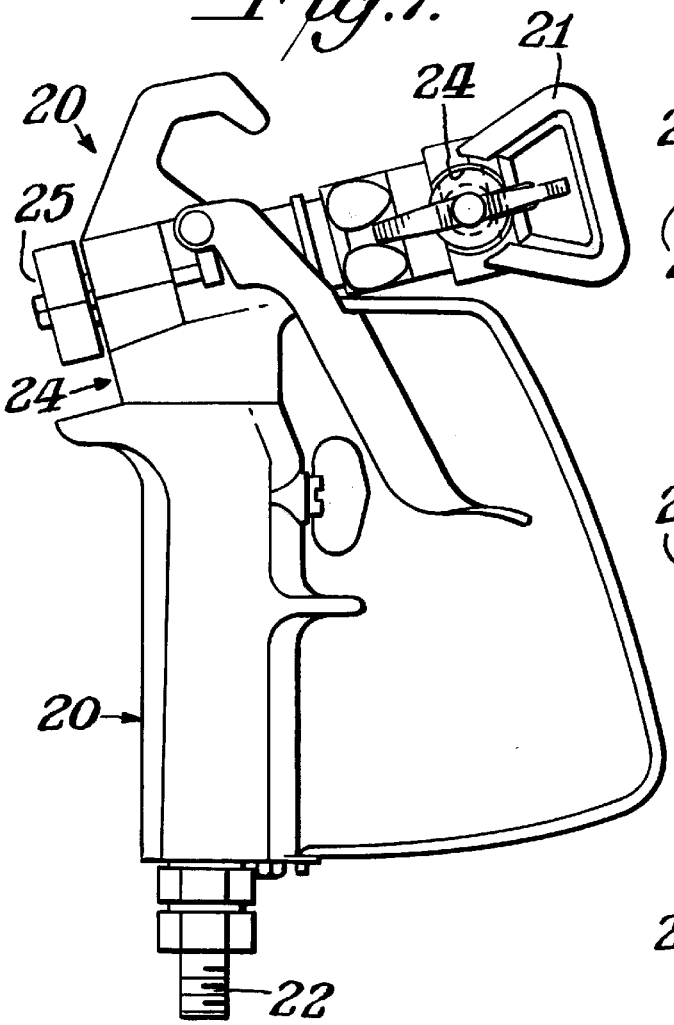
FIG. 7 is a side elevational view of a spray gun and spray tip member of the present invention.

The spray tip member can be used with a removable spacer 10, adapted to fit around the cylindrical body of the spray tip or turret member and adjacent to the handle 2. The spacer is shown in FIGS. 4–6 in use with the spray tip. The spacer 10 may comprise a tab 11 designed to interact with the housing of the spray gun to limit the rotational movement of the spray tip member when inserted into the orthogonal bore of the housing. See FIGS. 5 and 11. More specifically, the tab can interact with the channel formed in the housing adjacent to the opening of the orthogonal bore to limit the rotational movement of the spray tip member, and in embodiments wherein multiple channels arc formed in the spray gun housing (See FIGS. 16–19), the tab can interact with different Channels to define and limit the transverse position of the spray tip in member. The spacer defines and limits the transverse position of the spray tip member with respect to the spray gun housing, so that a first orifice member of the spray tip member is aligned with the longitudinal passage formed in the housing when the spacer and spray tip member are inserted into the orthogonal bore of the housing. The spacer should have a width that relates to the distance between the orifice members, so that when the spacer is removed and the spray tip member reinserted into the orthogonal bore, 4 different orifice member is positioned in alignment with the longitudinal passage of the spray gun housing. In preferred embodiments, the spacer should have a width equal to the distance between the center of the transverse bores or the center of the spray tip orifices.

The spacer 10, shown in FIGS. 4 and 6 is a hollow cylinder having an interior diameter substantially equal to the outer diameter of the spray tip member, so that the spacer can fit snugly around the spray tip member. The spacer comprises a tab 11 and can further comprise a notch 12 adapted to mate with or receive the tab 2C on the spray tip handle.

If the spray tip member comprises three orifice members, the present invention should comprise two removable spacers. To utilize the first of the three orifice members, both spacers are used with the spray tip member. After the first orifice member is used, the spray tip member can be removed from the orthogonal bore, and one of the spacers removed prior to reinsertion. When the spray tip member is reinserted with one of the spacers removed, a second orifice member is positioned for use, in alignment with the longitudinal passage of the housing. To use the third orifice member, both removable spacers are removed and the spray tip member is reinserted.

A tab 2C can be formed on the handle of the spray tip member, and is adapted to interact with the housing of the spray gun to limit the rotational movement of the spray tip member when inserted into the orthogonal bore of the housing without the spacer. The interaction of the tab 2C and the housing enable the user to quickly rotate the spray tip member from the in use position to the reversed or cleaning position, and back to the in use position. The tab can also be formed on each of the removable spacers. The tab can also be a removable component of either the handle or the spacer.

Positioning of the multiple orifices within the spray gun housing can be achieved through the use of a spacer. The spacer or tab can be removable and can be placed over the cylindrical turret, limiting the depth of tip insertion into the orthogonal bore of the housing and aligning one of the orifices in the operational position, while placing the other orifice in an inactive position covered by the housing so as not to become fouled by overspray or other foreign matter. The spacer can also align the orifice with the fluid stream when rotated for cleaning or for spraying. Removal of the indexing spacer brings the second orifice into the active position and places the first orifice in the inactive position, where it is covered by the spray gun housing to prevent fouling.

In alternate embodiments of the present invention, shown in FIGS. 16–19, the spray tip member is provided with a tab 2C, and the spray gun housing has two parallel channels formed therein and adapted to interact with the tab. If the spray tip member has two orifice members, there will be two parallel channels, if there are three orifice members, there will be three channels. When the spray tip member interacts with a first channel, a first orifice member will be aligned with the longitudinal passage formed in the housing. When the spray tip member is adjusted so that the tab interacts with a second channel, a second orifice member will be aligned with the longitudinal passage.

Another embodiment of the present invention, adapted for use with a spray gun housing having a single channel, the spray tip member comprises a removable spacer, formed on the handle or as a separate removable component. The spacer interacts with the channel so that a first orifice member is aligned with the longitudinal passage of the housing. When the spacer is removed, a second orifice member is aligned with the longitudinal passage.

Another embodiment of the present invention is a spray tip member having multiple orifice members on either side of the handle, so that the spray tip can be adjusted by the removal or addition of the spacer, and then reversed and similarly adjusted, doubling the number of orifice members that can be provided. In such embodiments, the spray tip member should be provided with a sleeve or sheath to cover the unused end of the spray tip member while the other end is in use. The handle on such embodiments should also be able to be transformed, so that when the spray tip member is reversed, the handle indicators can be reversed.

Another alternate embodiment of the present invention that can be used with or without a removable spacer, depending on the number of orifice members formed on the spray tip member, is adapted for use with a spray gun housing having holes formed at opposite ends of the orthogonal bore. If the spray tip member is used with a removable spacer, the holes can be similarly configured. If the spray tip is used without a removable spacer, each hole must be configured differently, so that each interacts with the spray tip member by positioning it in alternate positions so that alternate orifice members are positioned in alignment with the longitudinal passage of the spray gun housing.

The above described and other embodiments of the present invention provide an efficient means of painting or spraying fluid, without requiring tools or complicated assembly, and while providing multiple spray tip orifice members for each spray tip.

I claim:

1. In a spray gun of an airless spray system comprising a housing, a spray guard, a transverse passage and an orthogonal bore connected to the transverse passage, a removable, rotatable cylindrical turret member having a handle and at least two orifice members mounted in at least two transverse bores, the turret member being adapted for insertion into the orthogonal bore of the spray gun housing in a position wherein at least one of the orifice members of the turret member is aligned with the transverse passage, the turret member further comprising at least one removable spacer, wherein the handle comprises a removable tab positioned to interact with the housing to limit the depth of insertion and rotational movement of the turret when inserted into the orthogonal bore of the spray gun housing, and wherein the at least one removable spacer comprises a tab positioned to interact with the housing to limit the depth of insertion and rotational movement of the turret when inserted into the orthogonal bore of the spray gun housing.

2. A turret member of claim 1 having three orifice members mounted in three transverse bores, wherein the turret member further comprises two removable spacers.

3. A turret member of claim 1 wherein all of the transverse bores are parallel to each other.

4. A turret member of claim 1 wherein all of the transverse bores are askew with respect to each other.

5. In a spray gun of an airless spray system comprising a housing, a spray guard, a transverse passage and an orthogonal bore connected to the transverse passage, a removable, rotatable cylindrical turret member of claim 1 comprising at least one orifice member on one side of the handle, and at least one orifice member on another side of the handle.

6. In a spray gun comprising a housing, a spray guard, a transverse passage and an orthogonal bore connected to the transverse passage, a removable, rotatable cylindrical turret member having a handle and at least one orifice member mounted in at least one transverse bore, the turret member being adapted for insertion into the orthogonal bore of the spray gun housing in a position wherein at least one of the orifice members formed in the at least one transverse bore of the turret member is aligned with the transverse passage of the housing, the turret member further comprising at least one removable tab positioned to interact with the housing to limit the rotational movement of the turret when inserted into the orthogonal bore of the spray gun housing.

7. A turret member assembly for use with a spray gun of an airless spraying system, the spray gun comprising a spray gun housing, the spray gun housing having a longitudinal passage connected to an adjacent orthogonal bore, the orthogonal bore being adapted for the insertion of the turret member, the turret member being cylindrical and having at least two transverse passages formed therein, each passage having an orifice spray tip member disposed therein, the turret member further comprising a handle, and wherein the orthogonal bore of the housing has an opening formed at each end thereof, and wherein a first of the at least two transverse passages formed in the turret member is aligned with the longitudinal passage when the turret member is inserted through a first opening formed in the housing and into the orthogonal bore, and wherein a second of the at least two transverse passages formed in the turret member is aligned with the longitudinal passage when the turret member is inserted through a second opening formed in the housing and into the orthogonal bore.

8. A turret member assembly of claim 7, for use with a spray gun of an airless spraying system, the spray gun comprising a spray gun housing, the spray gun housing having a longitudinal passage connected to an adjacent orthogonal bore, the orthogonal bore being adapted for the insertion of the turret member, the turret member being cylindrical and having at least three transverse passages formed therein, each passage having an orifice spray tip member disposed therein, the turret member further comprising a handle and at least one removable spacer, and wherein the orthogonal bore of the housing has an opening formed at each end thereof, and wherein a first of the at least three transverse passages formed in the turret member is aligned with the longitudinal passage when the turret member is inserted through a first opening formed in the housing and into the orthogonal bore, and wherein a second of the at least three transverse passages formed in the turret member is aligned with the longitudinal passage when the turret member is inserted through a second opening formed in the housing and into the orthogonal bore, and wherein a third of die at least three transverse passages formed in the turret member is aligned with the longitudinal passage when the turret member is inserted through an opening formed in tie housing and into the orthogonal bore with the at least one removable spacer.

9. A turret member assembly of claim 7 for use with a spray gun of an airless spraying system, wherein the spray gun housing comprises at least one removable spacer or tab, wherein the at least one removable spacer or tab is adapted to interact with the turret member housing to limit the depth of insertion and rotational movement of the turret when inserted into the orthogonal bore of the spray gun housing.

10. A turret member assembly for use with a spray gun of an airless spraying system, the spray gun comprising a spray gun housing, the spray gun housing having a longitudinal passage connected to an adjacent orthogonal bore, the orthogonal bore being adapted for the insertion of the turret member, the turret member being cylindrical and having at least two transverse passages formed therein, each passage having an orifice spray tip member disposed therein, the turret member further comprising a handle and at least one removable spacer;

the housing further comprising at least two parallel channels formed therein, each channel being adapted to interact with one of the at least one removable spacers to define and restrict the position and rotational movement of the turret when inserted into the orthogonal bore.

11. A turret member assembly for use with a spray gun of an airless spraying system, the spray gun comprising a spray gun housing, the spray gun housing having a longitudinal passage connected to an adjacent orthogonal bore, the orthogonal bore being adapted for the insertion of the turret member, the turret member being cylindrical and having at least two transverse passages formed therein, each passage having an orifice spray tip member disposed therein, the turret member further comprising a handle and a tab;

the housing further comprising at least two parallel channels formed therein, each channel being adapted to interact with the tab to define and restrict the position and rotational movement of the turret when inserted into the orthogonal bore.

12. A turret member assembly of claim 11, wherein a first of the at least two transverse passages of the turret member is aligned with the longitudinal passage of the housing when the tab is positioned within a first of the at least two parallel channels formed in the housing.

13. A turret member assembly of claim 11, wherein a second of the at least two transverse passages of the turret member is aligned with the longitudinal passage of the housing when the tab is positioned within a second of the at least two parallel channels formed in the housing.

* * * * *